US011759788B2

(12) United States Patent
Brifman et al.

(10) Patent No.: US 11,759,788 B2
(45) Date of Patent: Sep. 19, 2023

(54) GRINDING APPARATUS

(71) Applicants: Joseph Brifman, Palm Coast, FL (US); Oleksandr Harni, Kyiv (UA)

(72) Inventors: Joseph Brifman, Palm Coast, FL (US); Oleksandr Harni, Kyiv (UA)

( * ) Notice: Subject to any disclaimer, the term of this patent is extended or adjusted under 35 U.S.C. 154(b) by 176 days.

(21) Appl. No.: 17/337,769

(22) Filed: Jun. 3, 2021

(65) Prior Publication Data

US 2021/0379597 A1 Dec. 9, 2021

Related U.S. Application Data

(60) Provisional application No. 63/034,930, filed on Jun. 4, 2020.

(51) Int. Cl.
*B02C 13/10* (2006.01)
*B02C 13/28* (2006.01)

(52) U.S. Cl.
CPC ..... *B02C 13/10* (2013.01); *B02C 13/2804* (2013.01); *B02C 2013/2812* (2013.01)

(58) Field of Classification Search
CPC ..... B02C 13/10; B02C 13/2804; B02C 2013/2812
See application file for complete search history.

(56) References Cited

U.S. PATENT DOCUMENTS 1,457,693 A * 6/1923 Dorn ..... B02C 13/20 241/39
1,621,409 A * 3/1927 Horn ..... B02C 13/10 241/154
1,718,184 A * 6/1929 Ostermann ..... B02C 13/10 241/261.1
1,811,438 A * 6/1931 Riley ..... B02C 13/22 241/86.1
1,902,591 A * 3/1933 Sprado ..... B02C 13/00 241/102
2,306,698 A * 12/1942 Heller ..... B01J 2/16 425/222
2,550,802 A * 5/1951 Gholson ..... C09C 1/58 425/222
2,651,471 A * 9/1953 Noll ..... B02C 13/282 241/86.1
3,346,240 A * 10/1967 Lavelle ..... A21C 1/065 366/168.1

(Continued)

*Primary Examiner* — Faye Francis
(74) *Attorney, Agent, or Firm* — Brennan, Manna & Diamond, LLC

(57) ABSTRACT

An apparatus for rotationally grinding, pulverizing, or comminuting bulk materials. A material processing component of the apparatus is fed at an input end by a hopper. The material enters the material processing component for processing and is propelled out of an output end through an outlet into a tray or piping. A cylinder of the material processing component is protected by an exterior insulating compartment and a replaceable inner liner. The cylinder defines a horizontal stationary work area. A rotatable shaft penetrates the cylinder along an axis of the working area. A plurality of working bodies are attached to the shaft in a narrowing helical orientation that also narrows in distance between working bodies from front to back. The working bodies are configured to comminute the material and direct it toward the outlet as the material passes through the working area.

12 Claims, 3 Drawing Sheets

(56) References Cited

U.S. PATENT DOCUMENTS 3,522,934 A * 8/1970 Ulrich ..... B29B 7/002 241/62
3,787,161 A * 1/1974 Frye ..... B29B 9/00 425/222
3,825,233 A * 7/1974 Henderson ..... B01J 2/10 425/222
3,973,735 A * 8/1976 Ito ..... B02C 17/002 241/73
4,015,829 A * 4/1977 Forster ..... B27N 1/0245 366/173.2
4,076,177 A * 2/1978 Hirayama ..... B02C 13/2804 241/73
4,082,232 A * 4/1978 Brewer ..... B02C 18/184 241/243
4,136,975 A * 1/1979 Forseth ..... B01F 27/0722 425/222
4,154,407 A * 5/1979 Lamort ..... B07B 1/24 209/34
4,162,287 A * 7/1979 Gunnell ..... C09C 1/58 425/222
4,166,722 A * 9/1979 Geissler ..... B01J 2/10 264/117
4,222,727 A * 9/1980 Adachi ..... B29B 9/00 264/117
4,240,590 A * 12/1980 Lautenschlager ... B02C 13/2804 241/188.1
4,502,858 A * 3/1985 Kertok ..... B01F 27/7221 425/222
5,413,284 A * 5/1995 Hirz ..... C04B 18/167 241/DIG. 38
5,433,388 A * 7/1995 Hirz ..... B02C 23/18 241/23
5,570,517 A * 11/1996 Luker ..... F26B 17/20 34/586
5,829,649 A * 11/1998 Horton ..... B02C 13/288 406/135
5,887,808 A * 3/1999 Lucas ..... B02C 13/2804 241/82
5,941,467 A * 8/1999 McArdle ..... B02C 13/288 241/5
6,248,156 B1 * 6/2001 Lucas ..... B01D 47/18 96/368
7,222,725 B1 * 5/2007 Somarakis ..... B65G 33/14 366/327.2
9,308,673 B2 * 4/2016 Feng ..... B29B 17/02
11,224,990 B2 * 1/2022 Dubey ..... B28B 13/0275
2002/0092938 A1 * 7/2002 Huang ..... B02C 13/14 241/19
2009/0050720 A1 * 2/2009 Kikuchi ..... B29B 17/0404 241/24.1
2018/0036912 A1 * 2/2018 Dubey ..... B28C 5/1238

* cited by examiner

GRINDING APPARATUS

CROSS-REFERENCE TO RELATED APPLICATION

The present application claims priority to, and the benefit of, U.S. Provisional Application No. 63/034,930, which was filed on Jun. 4, 2020 and is incorporated herein by reference in its entirety.

BACKGROUND OF THE INVENTION

The present invention generally relates to an apparatus for reducing material in size, and more specifically to an apparatus configured to rotationally comminute, grind or pulverize material. Accordingly, the present specification makes specific reference thereto. However, it is to be appreciated that aspects of the present invention are also equally amenable to other like applications, devices, and methods of manufacture.

FIELD OF THE INVENTION

Currently, there are a large number of grinding devices that provide fine powders using multi-stage technologies, with equipment for coarse crushing (jaw crushers, cone crushers), for medium crushing (hammer, rotary crushers), and for fine grinding (ball mills). Organic materials, such as grains, are typically crushed with hammer disintegrators. Hammer disintegrators work by friction grinding (mills with millstones, cone grinders), impact grinding (rotor, hammer, crushers, finger, Hint mills), or dehullers (separation of husks from plant seeds). The operation of these grinders is based on several principles: each particle (or grain) is exposed to the crushing tools wall, disk, ball, other particles, or the surface of the cone; the volume of the working area is partially unfilled; and to remove the shell from the grains, a classification of the latter by size is required.

The above grinders require a significant capacity of the working area, a big area of the working surfaces, and the mass of the working tools. Moreover, the main components of the equipment must be made of special wear-resistant and shockproof steel grades or ceramic. The large mass of parts and the strength of the processed materials require significant energy costs. Known equipment is not intended for mixing grounded particles. For successful dehulling (for example, from seeds), size separation is necessary, which leads to a decrease in the yield of finished products.

Accordingly, there is a great need for a grinding device for use in construction, mining, agriculture, and food industries. There is also a need for a machine configured to create finely ground powders from bulk rock or plant raw materials. Similarly, there is a need for a grinding apparatus that is more efficient than existing grinders. There is also a need for a universal installation capable of grinding or mixing ground particles or removing the surface layer from the particles.

In this manner, the improved commemorative system of the present invention accomplishes all of the forgoing objectives, thereby providing an easy solution for eliminating the disadvantages of existing material grinding devices. A primary feature of the present invention is a grinding apparatus capable of efficiently grinding bulk materials. The present invention exceeds productivity of known equipment with comparable material and energy consumption. The improved grinding apparatus of the present invention is capable of comminuting materials into finely ground powders. Finally, the invention is capable of grinding bulk materials from a particle size of approximately 15-20 mm and below to a particle size of −44 microns with an output of at least 20-30% by weight and −150 microns with an output of at least 70-80% by weight.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an apparatus for rotationally grinding, pulverizing, or otherwise comminuting bulk materials. The apparatus is configured to crush material using an intensive rotational movement and create a helical movement of particles relative to an axis of the working area while moving the material along the specified axis. The apparatus comprises a bulk material input, a material possessing component, and an outlet.

The bulk material input is typically a hopper vertically disposed on the material possessing component. The bulk material input may comprises a control device or metering device proximal to an outlet of the bulk material input for controlling input of the bulk material into the material processing component. A branch pipe may direct the funneled bulk material into the material processing component.

The material processing component comprises a housing, an insulating component, and a cylinder. The housing surrounds or jackets the cylinder and creates an insulating compartment between the housing and the cylinder. The insulating compartment can be filled with water to cool the cylinder during grinding and to insulate against noise. The cylinder is capped at each end via a pair of flanges.

The cylinder defines a horizontally disposed stationary working area. The working area may be cylindrical or conical in shape. The cylinder comprises an input end and an output end comprising an outlet. The input end is adjacent to the outlet of the bulk material input. An inner surface of the cylinder is protected by a removable insert liner. The input of the crushed bulk materials is made to the working area through the branch pipe, which can be located along the radius or tangent to the working area, which is a circular pipe.

The material processing component further comprises a rotatable shaft and a plurality of working bodies. The rotatable shaft penetrates the cylinder through the flanges along an axis of the working area. The shaft comprises a plurality of holes or inserts for mounting the plurality of working bodies to extend from the shaft. The plurality of working bodies are oriented in a helical line along the shaft with a gap between each working body. The helical line may be a two or three-way helical line with a lead size that decreases along the shaft from the input end to the output end. The gap between the plurality of working bodies may similarly decrease along the shaft from the input end to the output end. The working bodies are configured to comminute the material and direct it toward the outlet as the material passes through the working area. The last two or three of the plurality of working bodies closest to the output end may be situated in a plane perpendicular to an axis of the shaft.

The apparatus may further comprise a motor. The motor may be attached to the material processing component by a common platform. The motor is in communication with the rotatable shaft via a drive belt. The drive belt transmits the rotation from the electric motor to the shaft. The resulting comminuted material is propelled and discharged from the end of the working area through an outlet into a tray or a flange for attaching a transporting device.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
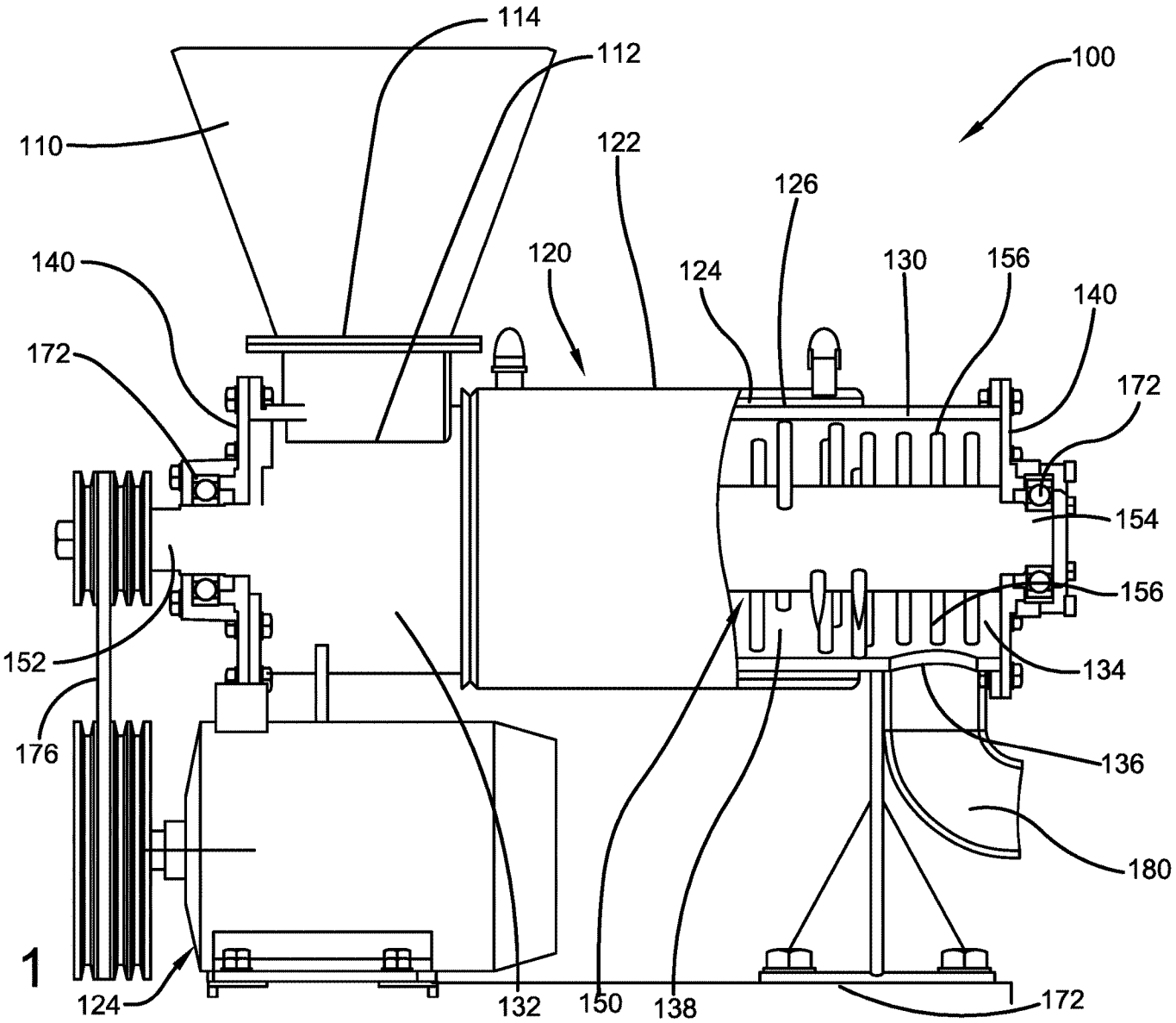
FIG. 1 illustrates a side cross-sectional view of an apparatus for grinding bulk material of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention provides a universal installation apparatus capable of grinding or mixing ground particles or removing the surface layer from the particles. The apparatus is particularly useful for grinding building materials (sand, fillers, components, concrete, etc.), rocks before processing, straw, plant stems, waste during threshing cereals, husks when cleaning grains of rice, sunflower, millet, etc., to obtain powders, mainly having size less than approximately 0.3 mm.

The apparatus is configured with a change in the grinding mode due to giving each particle of the treated material an intensive rotational movement and creating a helical movement of particles relative to the axis of the working area while moving the material along the specified axis using the action of rods located on the shaft along a helical line at the number of shaft revolutions above 1500 rpm/min. At the same time, the volume of a working zone is filled completely with crushed particles. The productivity of the apparatus exceeds the productivity of the known equipment by 3-10 times with comparable material and energy consumption. Moreover, the fineness of grinding powders (in one pass) is very high. Thus, the yield of the fraction "−44 μm" reaches 35-45%.

The grinding apparatus is capable of grinding bulk materials from a particle size of approximately 15-20 mm and below to a particle size of approximately −44 microns with an output of at least 20-30% by weight and approximately −150 microns with an output of at least 70-80% by weight. Power consumption should typically not exceed 10-15 kW/t. The technical solution result is the creation of a universal installation capable of grinding and/or mixing grounded particles and/or removing the surface layer from the particles. The apparatus can be used in the construction materials industry, in the mining industry, as well as agriculture, food, and other industries, in facilities that use finely ground powders from any rocks or from plant products as raw materials.

Referring initially to the drawings, FIG. 1 illustrates an apparatus 100 for grinding bulk material. The apparatus 100 comprises a bulk material input 110, a material possessing component 120, and an outlet 180. The bulk material input 110 is typically a hopper vertically disposed on the material possessing component 120. The bulk material input 110 may comprises a control device 114 or metering device proximal to an outlet 112 of the bulk material input 110 for feeding and controlling input of the bulk material into the material processing component 120. A branch pipe or similar directional element may further direct the funneled bulk material into the material processing component 120.

The material processing component 120 comprises a housing 122, an insulating compartment 124, and a cylinder 126. The housing 122 surrounds or jackets the cylinder 126 and creates the insulating compartment 124 separating the housing 122 and the cylinder 126. The insulating compartment 124 is watertight and can be supplied with running water to cool the cylinder 126 during material processing. The insulating compartment 124 also insulate the cylinder 126 to decrease noise pollution during operation. The cylinder 126 comprise is capped at each end via a pair of flanges 140 with installed closed bearings 172.

The cylinder 126 comprises an input end 132 and an output end 134 comprising an outlet 136. The input end 132 is adjacent to the outlet 112 of the bulk material input 110. An inner surface of the cylinder 126 is protected by a removable insert 130 or inner liner. The removable insert liner 130 may be constructed from a replaceable wear-resistant alloy having an opening of the shape and dimensions as the outlet 112 of the bulk material input 110.

The cylinder 126 defines a horizontally disposed stationary working area 138. The working area 138 may be cylindrical or conical in shape running between the input end 132 to the output end 134 with a larger base at the input end 132. The working area 138 is essentially a chamber in form of a cylinder or a truncated cone with a large base at the entrance, while a diameter of the working chamber 138 at the material outlet 112 refers to the diameter of the working chamber 138 at the material inlet d/D as 1/(1.5 to 1.7). The input of the crushed bulk materials is made into the working area 138 through the branch pipe, which can be located along the radius or tangent to the working area 138, which may be a circular pipe.

Figure 2:
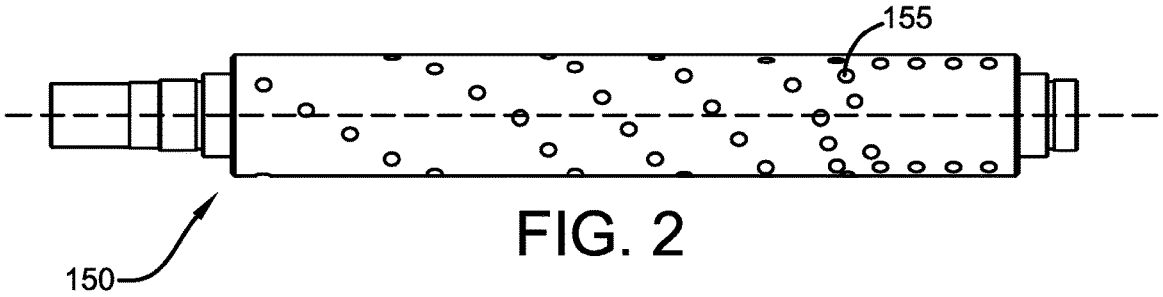
FIG. 2 illustrates an overhead perspective view of a shaft of the apparatus for grinding bulk material of the present invention in accordance with the disclosed architecture.
Figure 3A:
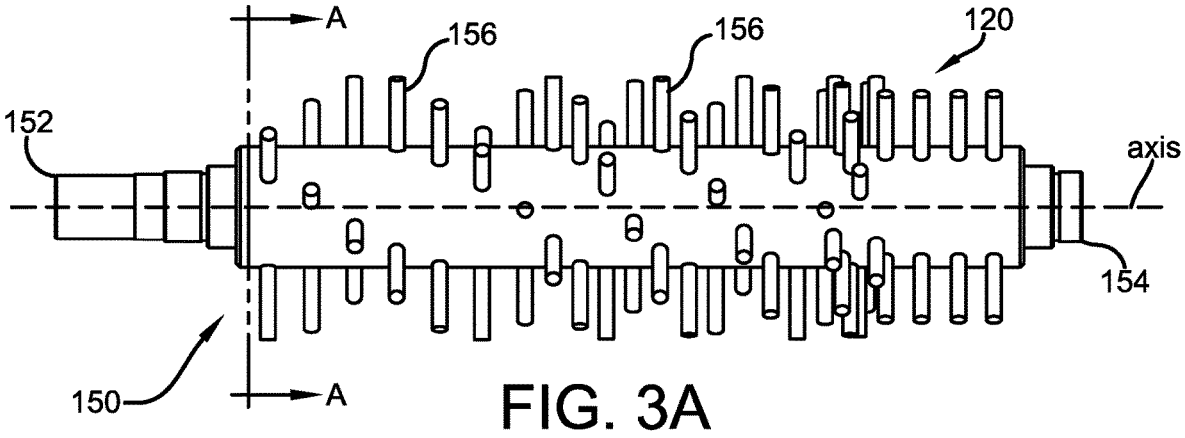
FIG. 3A illustrates a side perspective view of a plurality of rods attached to the shaft of the apparatus for grinding bulk material of the present invention in a helical orientation in accordance with the disclosed architecture.
Figure 3B:
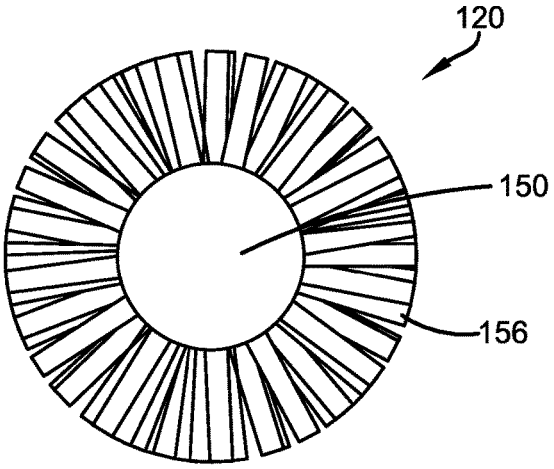
FIG. 3B illustrates an end cross-sectional view of the plurality of rods attached to the shaft of the apparatus for grinding bulk material of the present invention in a helical orientation in accordance with the disclosed architecture.

The material processing component 120 further comprises a rotatable shaft 150 and a plurality of working bodies 156. The rotatable shaft 150 penetrates the cylinder 126 through the flanges 140 along an axis of the working area 138. The shaft 150 comprises a drive end 152 having a mounted pully and a terminal end 154. As illustrated in FIGS. 2-3B the shaft 150 comprises a plurality of holes 155 or inserts for mounting the plurality of working bodies 156 to extend from the shaft 150. The plurality of working bodies 156 may be multipole rods or similar replaceable rods mountable to and extending from the rotatable shaft 150 constructed for grinding or pulverizing materials. The plurality of working bodies 156 are designed for quick dismantling and replacement. The rods 156 may have round screw threads 158 at one end of 2 or 3 lead-ins. The shaft 150 may also be equipped with two or three fans located directly under the receiving hopper 110.

Figure 4:
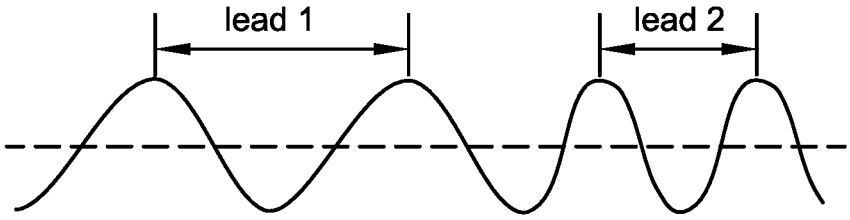
FIG. 4 illustrates a schematic view of a decreasing lead size of the helical orientation along the shaft of the apparatus for grinding bulk material of the present invention in accordance with the disclosed architecture.

The plurality of working bodies 156 are oriented in a helical line along the shaft 150 with a gap between each working body 156. As illustrated in FIG. 4, the helical line may be a two or three-way helical line with a lead size that decreases along the shaft 150 from the input end 132 to the output end 134 (lead 1 to lead 2). The lead size at the output 134 from the working area 138 can decrease up to 50 percent and is typically between approximately 0.5-0.6 of the lead size in the front 132 of the working area 138.

Figure 5:
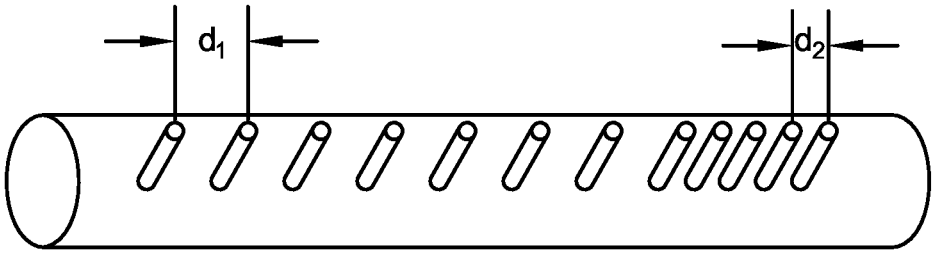
FIG. 5 illustrates a perspective view of a decreasing gap distance between the plurality of rods long the shaft of the apparatus for grinding bulk material of the present invention in accordance with the disclosed architecture.
Figure 6:
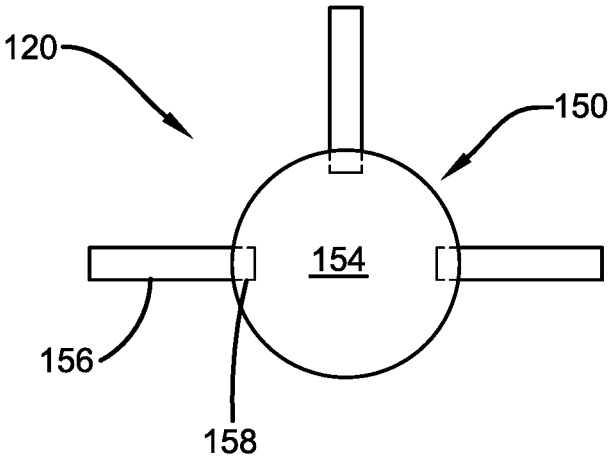
FIG. 6 illustrates an end view of the shaft of the apparatus for grinding bulk material of the present invention in accordance with the disclosed architecture.

As illustrated in FIG. 5, the gap between the plurality of working bodies 156 may similarly decrease along the shaft 150 from the input end 132 to the output end 134 (d1 to d2). The gap is determined and selected based on the size of the crushed bulk material to be processed. The rods 156 are typically installed between approximately 5 to 20 mm but may be as much as between 3 to 100 mm from each other. At the same time, the gap between the rods 156 decreases by between approximately 30-50%. The working bodies 156 are configured to comminute the material and direct it toward the outlet as the material passes through the working area. As illustrated in FIG. 6, the last two or three of the plurality of working bodies 156 closest to the output end 134 may be situated in a plane perpendicular to an axis of the shaft 150.

The apparatus 100 may further comprise a motor 174. The motor 174 may be attached to the material processing component 120 by a common mounting platform 178. The motor 174 is in communication with the mounted pully of the rotatable shaft 150 via a drive belt 176 or v-belt transmission. The drive belt 176 transmits the rotation motion from the electric motor 174 to the shaft 150. The resulting comminuted processed bulk material is propelled and discharged from the end of the working area 138 through the outlet 136 into the tray 180 or a flange for attaching a transporting device.

As a result of such a design of the apparatus 100, a transformation in the grinding regime is achieved by giving each particle of the treated material an intensive rotational motion and creating a helical motion of the particles relative to the axis of the working zone 138 while moving the material along the specified axis. At the same time, the volume of the working zone 138 is filled completely with crushed particles.

Helical and longitudinal movement of the material is performed using the shaft 150 equipped with the rods 156 that have a screw thread directed upwards. The powder is ejected by the rods 156 through the outlet 136 onto the tray 180. Instead of the tray 180, a branch pipe with a flange can be installed to create airtight transportation of the powder. To protect the bearings 172 at the port, there may be one or more propellers installed on the shaft 150 to throw the powder through the outlet 136 into the tray 180.

In operation, crushed stone, grain, flooring, straw, and other materials from the hopper 110 through the control device 114 fall into the working area 138 and are propelled under the impacts of the rods 156. As a result of the intensive rotation of the rods 156, the particles of materials also acquire a rotational movement and move along the zone to the output 136. While moving, the particles fall under multiple impacts of the rods 156 and interact with each other becoming pulverized. Moreover, in general, the strokes are sliding, which lead to the erasure of particles. Since the particles are under bending loads, much less energy is required for their destruction compared with the energy spent on destruction by direct impact. At the same time, the number of acts of impact on each particle is several orders of magnitude greater (there are many more rods) than, for example, in a hammer mill. Moving along the working area 138, the particles continuously decreases in size. The particles experience more and more blows due to the reduction of lead and the increase in the number of working rods 156. This means that the energy of the impact on the particle is constantly increasing and reaches the maximum value by the outlet. The more efficiently the specified grinding mechanism works, the greater the number of revolutions of the shaft 150. The speed and other parameters of the rods 156 and rotating crushing elements can be adjusted for particular types of materials.

Experimentation shows that when grinding very hard materials, such as granite, crushed stone, syenite, the grit of quartz pipes, glass breakage, etc., the working rods 156 hardly wear out. Therefore, the consumption of working rods 156 is much less than the balls in a ball mill or impact bars in a hammer mill. This fact indicates that the part of direct impact is much smaller than in these devices. The assumption is also confirmed by the fact that the rods 156 located at the very start of the working area (50-60 mm) really wear out significantly more than those farther along the axis. This means that large pieces, falling from the propeller to the working rods 156, cause a direct hit. But then, acquiring intense torsion, they already fall under bending forces impact and abrasion. As a result, the performance of the apparatus 100 is much higher than that of traditional crushers and mills. Moreover, its dimensions are much smaller than centrifugal crushers, hammer, and ball mills. At the same time, energy costs are also lower.

The apparatus 100 has effectively been shown to ground crushed stone, obtained after preliminary crushing on jaw and hammer (rotor) crushers (with sizes up to 25 mm) and to obtain powders of fineness less than 0.35 mm with a yield of 62-75%, of which less than −0.044 mm to 35%. The apparatus 100 can also grind grain, meal, and floor to a size of not more than 1 mm, which meets the needs of feed-milling establishments. Simultaneously with grinding in the working area of the apparatus 100, it is possible to perform highly efficient mixing of various components.

Table 1 provides some examples of some inorganic materials ground by the apparatus 100.

TABLE 1

| Material | Initial material, mm | Particle size +3.0 mm | +0.35 mm | +0.160 mm | +0.100 mm | +0.044 mm | Less 0.044 mm |
|---|---|---|---|---|---|---|---|
| Granite | ~20 | 3.6 | 38.6 | 13.43 | 6.8 | 11.63 | 25.94 |
| Granite (shaft with reduced pitch) | ~20 | — | 24.8 | 22.1 | 15.2 | 4.8 | 33.1 |
| Syenite | ~20 | 1.6 | 31.1 | 12.0 | 14.8 | 8.8 | 31.70 |
| Broken quartz and glass | ~15 | 1.6 | 30.0 | 14.0 | 15.0 | 15.4 | 24.0 |

Notwithstanding the forgoing, the apparatus 100 can be any suitable size, shape, and configuration as is known in the art without affecting the overall concept of the invention, provided that it accomplishes the above stated objectives. One of ordinary skill in the art will appreciate that the shape and size of the apparatus 100 and its various components, as show in the FIGS. are for illustrative purposes only, and that many other shapes and sizes of the apparatus 100 are well within the scope of the present disclosure. Although dimensions of the apparatus 100 and its components (i.e., length, width, and height) are important design parameters for good performance, the apparatus 100 and its various components may be any shape or size that ensures optimal performance during use and/or that suits user need and/or preference. As such, the apparatus 100 may be comprised of sizing/shaping that is appropriate and specific in regard to whatever the apparatus 100 is designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus for grinding bulk material comprising:
- a material processing component comprising:
  - a cylinder defining a horizontally disposed working area, the cylinder comprising an input end and an output end;
  - a shaft penetrating the cylinder along an axis of the working area;
  - a metering device for controlling an input of a material into the cylinder; and
  - a plurality of working bodies mounted to and extending from the shaft oriented in a helical line; and
- wherein a gap between each of the working bodies decreases between 30 and 50 percent between the input and output ends; and
- wherein only a last three of the plurality of working bodies closest to the output end are situated in a plane perpendicular to an axis of the shaft.

2. The apparatus of claim 1, wherein the working area is stationary, and the shaft rotates within the working area.

3. The apparatus of claim 1, wherein the plurality of working bodies are replaceable rods.

4. The apparatus of claim 1, wherein each gap is between 5 to 20 millimeters in length.

5. The apparatus of claim 1, wherein a lead size of the helical line decreases along the shaft between the input and output ends.

6. The apparatus of claim 5, wherein the lead size decreases by up to 50 percent.

7. An apparatus for grinding bulk material comprising:
- a material processing component comprising:
  - a cylinder defining a horizontally disposed stationary working area, the cylinder comprising an input end and an output end;
  - a rotatable shaft penetrating the cylinder along an axis of the working area;
  - a housing surrounding the cylinder forming a water-tight cooling compartment separating the housing from the cylinder configured to accept running water to cool the cylinder; and
  - a plurality of replaceable rods mounted to and extending from the rotatable shaft oriented in a helical line; and
- a bulk material input feeding the material processing component;
- an outlet in the output end of the cylinder; and
- wherein a lead size of the helical line decreases by up to 50 percent along the shaft between the input and output ends; and wherein only a last three of the plurality of working bodies closest to the output end are situated in a plane perpendicular to an axis of the shaft.

8. The apparatus of claim 7, wherein the material processing component further comprises a removable inner liner.

9. The apparatus of claim 7, wherein the horizontally disposed stationary working area is cylindrical in shape.

10. The apparatus of claim 7, wherein horizontally disposed stationary working area is shaped as a truncated cone with a larger base at the input end.

11. The apparatus of claim 7, wherein processed bulk material is propelled out of the working area through the outlet.

12. An apparatus for rotationally grinding bulk material comprising:
- a material processing component comprising:
  - a cylinder defining a horizontally disposed stationary working area, the cylinder comprising an input end and an output end;
  - a metering device for controlling an input of a material into the cylinder;
  - a rotatable shaft penetrating the cylinder along an axis of the working area;
  - a housing surrounding the cylinder forming a water-tight cooling compartment separating the housing from the cylinder configured to accept running water to cool the cylinder; and
  - a plurality of replaceable rods mounted to and extending from the rotatable shaft oriented in a two or three-helical line with a decreasing lead size and a decreasing gap between each of the replaceable rods from the input end to the output end; and a bulk material input feeding the cylinder at the input end;

an outlet in the output end of the cylinder; and a motor in communication with the rotatable shaft via a drivebelt; and wherein the gap between each of the replaceable rods decreases by up to 50 percent between the input and output ends; and wherein the lead size of the helical line decreases by up to 50 percent along the rotatable shaft between the input and output ends; and wherein only a last three of the plurality of replaceable rods closest to the output end are situated in a plane perpendicular to an axis of the shaft.

* * * * *